US005569407A

United States Patent [19]

Avery et al.

[11] Patent Number: 5,569,407

[45] Date of Patent: Oct. 29, 1996

[54] ADDITIVES FOR FUELS AND LUBRICANTS

[75] Inventors: Noyes L. Avery, Bryn Mawr; Joan C. Axelrod, Media, both of Pa.; James T. Carey, Medford, N.J.; John Hiebert, Levittown, Pa.; Andrew G. Horodysky, Cherry Hill, N.J.

[73] Assignee: Mobil Oil Corporation, Fairfax, Va.

[21] Appl. No.: 435,908

[22] Filed: May 5, 1995

Related U.S. Application Data

[62] Division of Ser. No. 217,820, Mar. 25, 1994, abandoned.

[51] Int. Cl.[6] ..... C10M 133/04; C10M 133/16

[52] U.S. Cl. ..... 508/454

[58] Field of Search ..... 252/51.5 A, 51.5 R; C10M 133/04, 133/16

[56] References Cited

U.S. PATENT DOCUMENTS

| | | | |
|---|---|---|---|
| 3,337,459 | 8/1967 | Ford | 252/51.5 A |
| 3,857,791 | 12/1974 | Marcellis et al. | 252/51.5 A |
| 3,873,460 | 3/1975 | Coon et al. | 252/51.5 A |
| 4,605,808 | 8/1986 | Samson | 585/525 |
| 4,705,643 | 11/1987 | Nemo | 252/51.5 A |
| 4,832,702 | 5/1989 | Kummer et al. | 44/412 |
| 5,241,003 | 8/1993 | Degonia et al. | 525/123 |

*Primary Examiner*—Prince Willis, Jr.
*Assistant Examiner*—Cephia D. Toomer
*Attorney, Agent, or Firm*—Ronald A. Bleeker; Malcolm D. Keen; Penny L. Prater

[57] ABSTRACT

Polyalkylene amine coupled carboxylates are effective multifunctional additives, providing cleanliness to fuels and lubricants as well as friction-reducing and corrosion-inhibiting properties.

4 Claims, No Drawings

ADDITIVES FOR FUELS AND LUBRICANTS

This is a division of application Ser. No. 08/217,820, filed on Mar. 25, 1994, now abandoned.

FIELD OF THE INVENTION

This invention is directed to polyalklene amines which have been reacted with carboxylate groups to form polymeric amine carboxylates, and the use of the resulting products as additives in fuels and lubricants. More particularly, it is directed to fuel and lubricating compositions containing such additives.

BACKGROUND OF THE INVENTION

Additives impart special qualities to fuels and lubricants, providing new properties or enhancing those already present. The use of polyalkylene amines in fuel compositions as detergents is well known. They are effective in maintaining the cleanliness of the mixture formation and intake system of gasoline engines (i.e., carburetor, injection nozzles, intake valves and mixture distributor), since they enable fuels to decompose cleanly at high temperatures leaving little or no residue. Fuel additives also reduce emissions from internal combustion engines. Polyalkylene amines have also been used as detergents in lubricants, in which they impart cleanliness and stability at high temperatures. Polyalkylene amines have generally been used as detergent additives. Other additives have been necessary to impart good friction reducing properties as well as antiwear and corrosion-inhibiting properties to the fuel or lubricant.

The beneficial effects of the product of the instant invention are believed to be the result of an internal synergism between the polyalkylene amine groups, and carboxylate groups. The additives of this invention show good thermal decomposition and oxidative stability and compatibility with other commonly used fuel or lubricant additives when admixed with them. They are effective performance enhancers in either fuel or lubricant compositions.

DESCRIPTION OF THE PRIOR ART

The use of polyalkyleneamines as additives in lubricant compositions is well known in the prior art. U.S. Pat. No. 5,152,909 (DeRosa et al) discloses the use of polyisobutyleneamines in the preparation of antioxidant and corrosion resistance additives for railway crankcase lubricants. Although the polyisobutyleneamines of DeRosa et al are linked with anhydrides, a type of carboxylate, to form the additive, they differ from the instant invention in the chemistry of their synthesis. DeRosa et al reacts maleic anhydride with oligomeric polyisobutylene to form oligomeric anhydride. The anhydride then reacts with n-alkyl diamine. The intermediate then reacts with polyaromatic diisocyanate, then with 1,3,4 thiadiazole.

U.S. Pat. Nos. 5,004,478 (Vogel et al); 5,112,364 (Rath et al) and DE3942860 disclose the use of polyisobutylenes amines alone as gasoline and fuel additives. These compositions provide thermal decomposition and cleanliness features. The polyisobutyleneamine additives of these inventions are not coupled with other compounds as in the instant invention.

Low molecular weight sulfur-containing heterocyclic additives such as those disclosed in U.S. Pat. Nos. 4,382,869 (Horodysky et al) and 4,301,019 (Horodysky et al) provide friction reducing and antiwear properties for lubricant applications. These compositions, however, do not provide the thermal decomposition and cleanliness features, coupled with the excellent detergency properties of the new fuel additives disclosed in the instant invention. These properties are critical for severe service fuel and lubricant applications.

SUMMARY OF THE INVENTION

The instant invention is directed to novel adducts of polymeric amines. More particularly, it is directed to products of fatty acids which are reacted with polyalkylene amines to form polymeric amine carboxylates. It has now been found that the use of polymeric amine carboxylates as additives in fuels and lubricant compositions can provide both excellent friction reducing and fuel economy improving properties coupled with superior high temperature thermal decomposing and cleanliness properties for use in light distillate hydrocarbon and/or oxygenated fuels. Additional detergency, corrosion inhibiting, metal deactivating and/or antioxidant properties are also potentially present.

The compositions of the instant invention are readily made in a one-step procedure that could, in one embodiment, be implemented during blending of the fuel additive component packages. For example, the components of this invention could be reacted together using an in-line mixer as a reactor, then promptly blended into the fuel. These additives could provide desirable performance features at a modest cost. Furthermore, they do not contain any environmentally or toxicologically undesirable materials or corrosive raw materials. Use in either fuels or lubricants could also reduce harmful emissions generated by internal combustion engines.

DESCRIPTION OF THE PREFERRED EMBODIMENTS

This invention is directed to additives suitable for use in fuels or lubricant oils prepared in a process comprising reacting in a suitable reaction zone a polyalkylene amine having an average molecular weight of about 500 to 2000 amu, and a carboxylate group such as an anhydride. The preferred polyalkyleneamines are those having a long chain hydrocarbon group of at least about 30 carbon atoms, preferably 30 to 120 carbon atoms. Amines of this type include polyisobutyleneamine. Such amines might also include alternate polymeric amines such as those below:

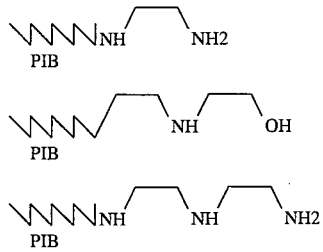

Polyalkyleneamines useful in this invention can be prepared by chlorination or hydroformulation of a reactive polyolefin such as polyisobutylene, and subsequent amination with ammonia, hydrocarbyl amine, hydrocarbyl diamine, hydrocarbyl polyamine, alkoxylated hydrocarbyl amines, or mixtures thereof. Ammonia, ethylenediamine, propylenetriamine, diethylenetriamine, triethylenetetramine, tetraethylenepentamine, piperazines, hexamethylenediamine, hydroxyalkylethylenediamines, hydroxyalkyl triethyleneteramines, and similar compounds can be converted to polyalkyleneamines by these procedures. Mixtures of the above and similar amines can also be used effectively. Alternatively, these amines can be prepared by chlorination or halogenation of appropriate polymeric olefins, and then converted into corresponding polyalkyleneamine derivatives using these or other known methods of manufacture.

Polyisobutylene (PIB) is an oligomeric isobutylene segment containing random 1,2 and 1,4-butylene repeat units shown below:

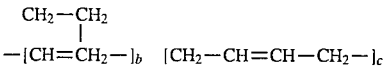

where the sum of the repeat units, b and c respectively, vary from 10 to 50 so that the oligomer has a corresponding molecular weight range between 500 and 2000 amu, preferably 1000 amu. The polyalkylene amines can also optionally contain sulfur, oxygen or additional nitrogen and may have other functional groups.

The generalized reaction is as follows;

—NH2+Carboxylate Group=Detergent with Friction-Reducing Properties

Carboxylate sources effective in the instant invention can include fatty acids, dimerized or trimerized acids, as well as functionalized acids such as sarcosines derived from acylated glycines. The carboxylate sources can contain from 10 to 50 or more carbon atoms, and can also optionally contain sulfur, nitrogen, or additional oxygen. Desirable carboxylates can include carboxylic acids, as well as carboxylate generating species such as anhydrides.

A dimer acid is a high molecular weight dibasic acid, which is liquid (viscous), stable, resistant to high temperatures, and which polymerizes with alcohols and polyols to yield a variety of products, such as plasticizers; lube oils, hydraulic fluids. It is produced by dimerization of unsaturated fatty acids at mid-molecule and usually contains 36 carbons. Trimer acid, which contains three carboxyl groups and 54 carbons, is similar.

The pressures employed in the instant invention range from subatmospheric to 500 psig. More preferred is the range from 50 to 500 psig. The temperature may range broadly from 0° C. (32° F.) to 150° C. (300° F.), more specifically from 60° C. (140° F.) to 80° C. (176° F.). Solvents useful in the instant invention include aromatic and aliphatic hydrocarbons which contain from 5 to 15 carbon atoms. The solvent can optionally contain additional oxygen, sulfur or nitrogen.

Some of the most effective carboxylate groups in the instant invention include fatty acids such as oleic acid, dimerized fatty acids (such as dimerized linoleic acids), and acyl sarcosines (such as oleoyl sarcosine).

$CH_3—(CH_2)_7CH=CH(CH_2)_7COOH$ Oleic acid $CH_3—(CH_2)_4CH=CHCH_2CH=CH(CH_2)_7COOH$ Linoleic acid Two products of reaction, employing PIB-amine oleates and PIB-amine sarcosinates, are illustrated in a general form below, where R represents alkyl chains of from 10–50 carbon atoms, preferably 18–36 carbon atoms:

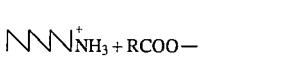

PIB-amine oleates
wherein R = H, $CH_3-$, $C_2H_5-$

-continued

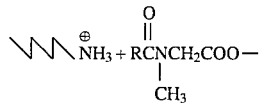

PIB-acyl sarcosinates

An excess of one reagent or another can be used in the instant invention. Molar quantities, or less than molar quantities of either polyalkylene amine or carboxylate generating species can be used. Preferred quantities of the acid range from less than molar to equimolar.

The fuels combined with the additive of this invention are liquid hydrocarbon combustion fuels, including the distillate fuels, i.e., gasoline and fuel oils. Accordingly, the fuel oils that may be improved in accordance with the present invention are hydrocarbon fractions having an initial boiling point of at least about 100° F. and an end-boiling point no higher than about 750° F. and boiling continuously throughout their distillation range. These fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate, gasoline, fuel oils, alcohols, oxygenated hydrocarbons, or mixtures of straight run distillate fuel oils, naphthas and the like, with cracked distillate stocks. Moreover, such fuel oils can be treated in accordance with well known commercial methods, including acid or caustic treatment, hydrogenation, solvent refining, clay treatment and the like. The distillate fuel oils are characterized by their relatively low viscosities, pour points, and similar properties. The principal property which characterizes the contemplated hydrocarbons, however, is the distillation range. As mentioned previously, this range lies between about 100° F. and about 750° F. The distillation range of each individual fuel oil will cover a narrower boiling range, but falling, nevertheless, within the above specified limits. Likewise, each fuel oil with boil substantially continuously throughout its distillation range. Contemplated among the fuel oils are numbers 1, 2, 3 fuel oil (useful in heating and in diesel engines), and the jet combustion fuels. The domestic fuel oils generally conform to the specifications set forth in ASTM Specifications D396-48T. Specifications for diesel fuels are defined in ASTM Specification D975-48T. Typically jet fuels are defined in Military Specifications. The specifications may at times be slightly varied.

The gasolines that are improved by the additive compositions of this invention are mixtures of hydrocarbons having an initial boiling point falling between about 75° F. and about 135° F. and an end-boiling point falling between about 250° F. and about 450° F. As is well known in the art, motor gasoline can be straight run stock, catalytic or thermal reformate, cracked stock, alkylated natural gasoline and aromatic hydrocarbons. All of these are contemplated.

If the additive compositions of this invention are to be incorporated into a lubricating oil they are added in a concentration of between 0.1 wt % and 2.0 wt %. If the composition is to be incorporated into a fuel such as distillate or gasoline, the concentration is between 1 and 500 pounds per thousand barrels. More preferably concentrations in a range between 5 and 100 pounds per thousand barrels of fuel can be used.

Of particular significance in the instant invention, in the case of lubricants, is the ability to impart cleanliness and stability features at high temperatures. The additives of this invention also improve the resistance to oxidation and corrosion of oleaginous materials. Such materials include lubricating media which may comprise liquid oils, in the form of either a mineral oil, or a synthetic oil, or mixtures thereof, or in the form of a grease in which any of the aforementioned oils are employed as a vehicle. Other additives, such as corrosion inhibitors, ignition enhancers, anti-knock additives, auxiliary detergents, etc. can be readily used in fuels in conjunction with the compositions of this invention. In general, mineral oils, both paraffinic, naphthenic and mixtures thereof, employed as the lubricant, or grease vehicle, may be of any suitable lubricating viscosity range, as for example, from about 45 SUS at 100° F. to about 600 SUS at 100° F., and preferably, from about 40 SUS to about 250 SUS at 210° F. These oils may have viscosity indexes ranging to about 100 or higher. Viscosity indexes from about 70 to about 95 are preferred. The average molecular weights of these oils may range from about 250 to 800. Additional agents, such as auxiliary detergents, corrosion inhibitors, antioxidants, antiwear agents, friction-reducing agents, etc. can be useful. Such agents can include phenates, sulfonates, succinimides, organic borates, phenols, succinic esters, amides, or dithiophosphates. Other additives may include polymeric viscosity index improvers.

Having described the invention broadly, the following are offered as specific illustrations. They are illustrative only and are not intended to limit the invention.

EXAMPLE 1

Reaction Product of Polyisobutyleneamine and Oleic Acid

About 147 g of an approximately 50% solution of polyisobutyleneamine in a hydrocarbon solvent having a molecular weight of about 1,000 g was combined with 22.5 g oleic acid in a reactor equipped with a heater and agitator.

The remaining 50% of the solution is comprised of a hydrocarbon solvent. After a slight exotherm to approximately 38° C. (100.4° F.), the reactants were heated to 75° C. (167° F.) with agitation for one hour. The final product yield at room temperature was 169 g of PIB amine oleate, a clear yellow liquid.

EXAMPLE 2

Reaction Product of Polyisobutyleneamine and Oleic Acid

The generalized procedure of Example 1 was followed, but 295 g of the above polyisobutyleneamine solution and 45 g of oleic acid were used. The final product yield was 339 g of PIB amine oleate, a clear yellow liquid, at room temperature.

EXAMPLE 3

Dehydrated Reaction Product of Polyisobutyleneamine and Oleic Acid

About 147 g of an approximately 50% solution of polyisobutyleneamine having a molecular weight of 1,000 g (the solution of Example 1), 22.5 g of oleic acid, and 50 ml toluene auxiliary solvent, were placed in a reactor equipped with agitator, heater, Dean-Stark tube with condenser, and provisions for blanketing the vapor space with inert (nitrogen) gas. Toluene was used to facilitate azeotropic water removal. The ingredients were heated to 75° C. (167° F.) with agitation for one hour. The temperature was then slowly raised to 166° C. (330.8° F.) for approximately 5 hours until water evolution during azeotropic distillation ceased. A total of 1 ml of water was collected. The product was distilled under reduced pressure to remove volatiles. Approximately 103 g of PIB amine oleate, a clear yellow viscous fluid, was isolated as product.

EXAMPLE 4

Reaction Product of polyisobutyleneamine, and Dimer Acid

Approximately 184 g of the polyisobutylene solution described in Example 1 was combined with 56 g of dimer acid (dimerized linoleic acid commercially obtained as Hystrene 3675 dimer acid) in a reactor equipped with a heater and agitator. After a slight exotherm to about 37° C. (98.6° F.), the reactants were heated to 75° C. (167° F.) with agitation for one hour. The product was a yellow/orange liquid (monolinoleate) when cooled to room temperature.

EXAMPLE 5

Reaction Product of Polyisobutyleneamine, and Dimer Acid

The generalized procedure of Example 4 was followed, but 184 g of the above polyisobutyleneamine solution and 28 g of the above dimer acids were used. After a slight exotherm to 34° C. (93.2° F.), the reactants were heated to 75° C. (167° F.) with agitation for one hour. The product, the di-linoleate, was a clear yellow liquid at room temperature.

EXAMPLE 6

Reaction Product of Polyisobutyleneamine, and Oleoyl Sarcosine

The generalized procedure of Example 1 was followed, but 184 g of the polyisobutyleneamine solution and 34.9 g of oleoyl sarcosine (commercially obtained as Hamposyl O from the Hampshire Chemical Co.) were used. After a slight exotherm to approximately 33° C. (91.4° F.) the reactants were heated to 75° C. (167° F.) with agitation for one hour. The product, oleoyl sarcosinate, was a clear yellow liquid after cooling to room temperature.

EXAMPLE 7

Reaction Product of Polyisobutyleneamine, and Lauroyl sarcosine

The generalized procedure of Example 6 was followed, but 92 g of the polyisobutyleneamine solution and 13.5 g of lauroyl sarcosine (commercially obtained as Hamposy L from Hampshire Chemical Co.) were used. After a slight exotherm to approximately 34° C. (93.2° F.), the reactants were heated to 75° C. (167° F.) with agitation for one hour. The product, lauroyl sarcosinate, was a clear yellow liquid after cooling to room temperature.

EXAMPLE 8

Reaction product of Polyisobutyleneamine and Cocoyl Sarcosine

The generalized procedure of Example 6 was followed, but 92 g of the polyisobutyleneamine solution and 14 g of cocoyl sarcosine (commercially obtained as Hamposyl C from Hampshire Chemical Co.) were used. After a slight exotherm to approximately 37° C. (98.6° F.), the reactants were heated to 75° C. (167° F.) with agitation for one hour. The product, cocyl sarcosinate, was a clear yellow liquid after cooling to room temperature.

Thermal Decomposition Properties

The products of the Examples were evaluated with respect to cleanliness during thermal decomposition using thermogravimetric analysis as shown in Table 1 below. Thermogravimetric analysis was performed by heating the sample at 20° C./min in air flowing at 100 ml/min using a thermogravimetric analyzer. The percent residue remaining at 425° C. was recorded; little or no residue is most desirable. As can be seen from the thermogravimetric analysis results, the products of this invention show exceptional cleanliness and high temperature decomposition features. Examples 7 & 8 left the least amount of residue.

TABLE 1

High Temperature Performance/Cleanliness Thermogravimetric Analysis

| Examples | % Residue @ 425° C. (797° F.) | Temp. for 0% Residue, °C. | °F. |
|---|---|---|---|
| 1 | 0.4 | 475 | 887 |
| 2 | 0.0 | 406 | 762.8 |
| 3 | 1.3 | 524 | |
| 6 | 1.3 | 532 | 989.6 |
| 7 | 0.0 | 425 | 797.0 |
| 8 | 0.0 | 415 | 779.0 |

Frictional Properties

The frictional properties of the compositions of this invention were then evaluated using the Low Velocity Friction Apparatus Test. Two weight percent of the additive was dissolved in a standard mineral oil reference fluid blended with a dispersant/detergent/inhibitor (DDI) performance package. The percent reduction in coefficients of friction relative to the reference oil was measured at 32–58 psi over a range of sliding speeds (5–30 ft/min) at both room temperature and at 250° F. The percent change in the coefficients of friction of the test oil with the examples when compared to the test oil without the examples is reported in Table 2 using an average of pressures at both 32 and 48 psi.

TABLE 2

Reduction of Coefficients of Friction

| Example | Reduction in Friction, % |
|---|---|
| Reference oil | 0 |
| Reference plus 2 wt % Example 1 | 42 |
| Reference plus 2 wt % Example 2 | 41 |
| Reference plus 2 wt % Example 3 | 3 |

The friction test results clearly show the friction reducing potential of these additives. It is interesting to note that the dehydrated product of Example 3 shows that dehydration suppresses the friction reducing potential of these compositions.

Catalytic Oxidation Test

The products of these Examples were then evaluated with respect to oxidative stability and corrosion reducing properties. In the Catalytic Oxidation Test the reference lubricant is subjected to a stream of air which is bubbled through at a rate of 5 liters per hour and 325° F. for forty hours. Present are samples of metals commonly used in engine construction such as iron, copper, aluminum and lead. U.S. Pat. No. 3,682,980, herein incorporated by reference in its entirety, may be consulted for more complete details of the test. Minimization of viscosity increase or neutralization number shows control of oxidation. The data are reported as increase in viscosity (%), increase in Total Acid number (TAN), and amount of lead loss, in mg., as shown in Table 3.

TABLE 3

Oxidative Stability/Corrosion Inhibition

| Example | Viscosity Increase % | Acid No. Increase | Lead Loss, mg |
|---|---|---|---|
| Fully formulated synthetic engine oil with DDI package | −2% | 0.48 | 0.2 |
| Reference oil plus 2 wt % of product of Example 1 | 0% | 0.71 | 0.8 |

The results clearly show that the products of this invention do not adversely affect the oxidative stability or corrosivity of petroleum products formulated therefrom. Slight increases in acid number and lead loss were noted, confirming good control of these two key properties which measure oxidative performance.

Copper Corrosivity

Example 1 was evaluated with respect to copper corrosivity properties. Two percent of Example 1 was blended into a 200 SUS solvent paraffinic neutral lubricating oil and evaluated using the Copper Strip Corrosivity Test, ASTM D-130 at 250° F. (121.11° C.) for three hours. The result were rated as 1A, indicating no corrosive tendencies. In fact, 1A is the best possible rating using this test for copper corrosivity.

What is claimed is:

1. A lubricant composition comprising a lubricating oil or a grease prepared therefrom and an effective amount, sufficient to enhance cleanliness, provide stability at high temperatures, retard wear, and inhibit corrosion in an engine, of a reaction product obtained by reacting (1) a polyisobutyleneamine which has been derived from polyisobutylene molecules of which at least 80% have a terminal vinyl group, with (2) a carboxylate group at a temperature in the range from 32° F. to 300° F. and at a pressure from subatmospheric to about 500 psig.

2. The composition of claim 1, wherein at least one compound selected from the group consisting of ammonia, ethylenediamine, diethylenetriamine, triethylenetetramine, tetraethylenepentamine, piperazines, hexamethylenediamine, hydroxylalkyl ethylenediamines, and hydroxyalkyl triethylenetetramines has been incorporated into the isobutylene amine by amination of the polyisobutylene.

3. The composition of claim 1, wherein the amount of reaction product present is in the range from 0.1 to 5.0 wt %.

4. The composition of claim 1, wherein the lubricating oil is selected from the group consisting of mineral oils, synthetic oils or mixtures thereof.

* * * * *